US005188168A

United States Patent [19]

Pond

[11] Patent Number: 5,188,168

[45] Date of Patent: Feb. 23, 1993

[54] CHILL BLOCK MELT SPINNING APPARATUS

[75] Inventor: Robert B. Pond, Westminster, Md.

[73] Assignee: Marvalaud, Inc., Westminster, Md.

[21] Appl. No.: 739,656.

[22] Filed: Aug. 2, 1991

[51] Int. Cl.[5] ..... B22D 11/06

[52] U.S. Cl. ..... 164/479; 164/429; 264/8; 425/8

[58] Field of Search ..... 164/479, 429, 46, 463, 164/423; 264/8; 425/8

[56] References Cited

FOREIGN PATENT DOCUMENTS 910737 3/1954 Fed. Rep. of Germany ..... 425/8

*Primary Examiner*—Kuang Y. Lin

*Attorney, Agent, or Firm*—Oliff & Berridge

[57] ABSTRACT

A chill block melt spinning apparatus produces flake-type powder of the smallest magnitude by centrifugal disintegration of molten metals and alloys. Molten metal or alloy is delivered to a rotating cup which centrifugally forces the metal to exit the cup tangentially in a sheet which breaks up into streams and then into a series of droplets. Rotating chill cylinders are radially spaced from the rotating cup. The cylinders receive the streams or droplets of semi-solidified metal and provide a fresh surface for each droplet to chill the droplets, forming ultra fine flakes while deflecting the flakes downward into a collecting area. The cylinders have a concave outer surface which corresponds to the shape of the rotating cup to provide an equidistant travel path from the rotating cup to a deflection contact surface for the radially travelling droplets.

17 Claims, 4 Drawing Sheets

FIGURE 3
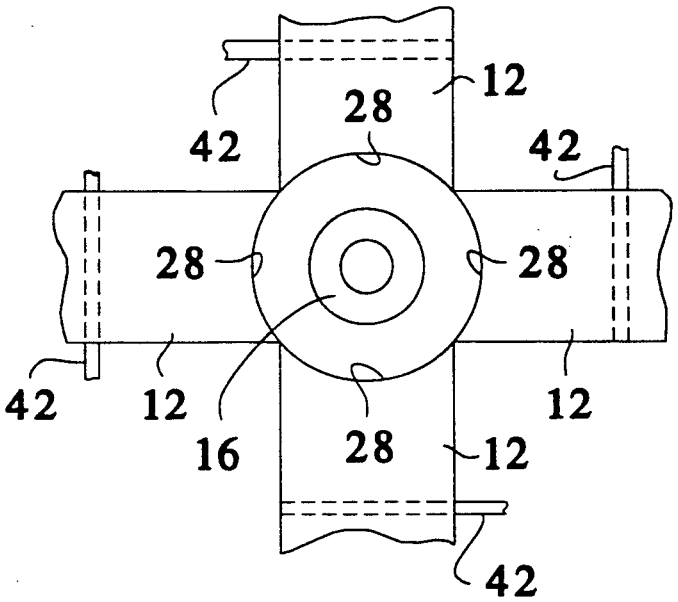
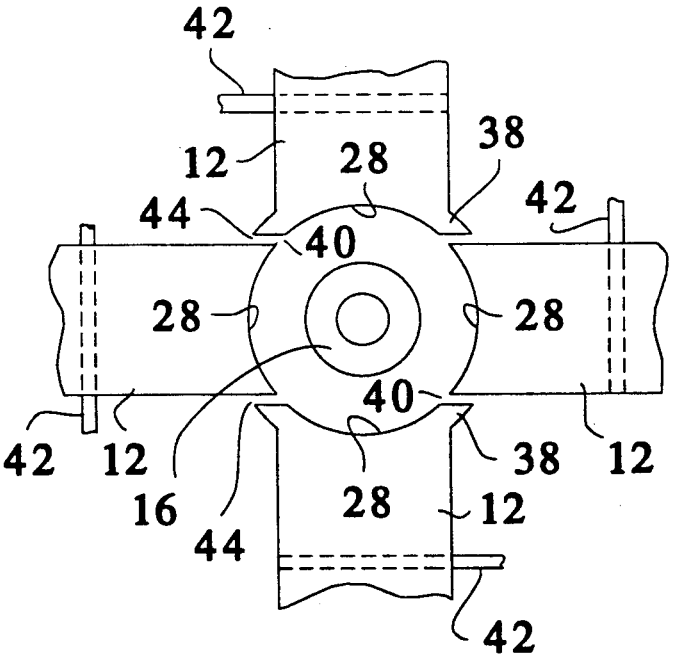
FIGURE 5

CHILL BLOCK MELT SPINNING APPARATUS

BACKGROUND OF THE INVENTION

1. Field of the Invention

The invention relates to a chill block melt spinning apparatus for producing flake-type powder of the smallest magnitude.

2. Description of Related Art

Continuous casting processes for producing metal wire or filaments from molten metal are well known in the art. The earliest practices of continuous casting of metals are found in the manufacture of shot in shot towers in the early 1800's. Continuous casting processes evolved into three primary categories: (1) processes wherein molten metal is contained on all sides; (2) processes wherein there is always a free surface, exemplified by chill block melt spinning; and (3) processes wherein molten metal is formed without a mold, such as by levitated casting or the continuous casting of hollow metal microspheres.

Chill block melt spinning produces long thin ribbons or extremely short flakes. The technique consists of ejecting molten metallic material through a small orifice to produce a continuous jet of liquid. If the jet remains molten for long times or over long distances, the surface tension forces of the material cause the jet to be broken up into droplets. If solidification of the jet occurs before this breakup then a round metallic wire is produced. If solidification occurs after the disintegration then shot or spherical powders are produced. The molten jet can be acted upon by causing it to impinge on a rotating chill block which may be a wheel or a curvilinear block. The surface velocity of the chill block at the point where the molten jet impinges is referred to as the "impingement velocity" ($V_i$). "Ejection velocity" ($V_e$) is the velocity of the molten stream just prior to contacting the chill surface. If the impingement velocity is approximately equal to the ejection velocity then a continuous ribbon having a width slightly larger than the jet diameter is produced. If $V_i$ is large relative to $V_e$ then a continuous, thin ribbon will be formed. The width of this ribbon will still be slightly larger than the jet diameter. As $V_i$ continues to increase relative to $V_e$, the ribbon becomes thinner until the jet can no longer supply enough material to maintain a continuous ribbon and the product becomes staple ribbon fiber. The length of the staple fiber becomes less as $V_i$ is further increased until finally a flake powder is produced.

There are six variables which can be manipulated to change the product produced by this type of process. These are orifice (jet) diameter, temperature of the molten alloy, surface tension of the alloy, ejection velocity, impingement velocity and the attack angle at which the jet approaches the chill block.

In applicant's own prior system, four rotating chill cylinders are located symmetrically around a rotating cup to provide a contact surface for streams or droplets travelling radially outward from the cup to form the droplets into flakes, to cool the metal and deflect the flakes. Such a system is shown with reference to FIGS. 1 and 2. In FIG. 1, there is shown a portion of a chill block melt spinning apparatus 10 including four rotating chill cylinders 12 which are individually driven by motors 14 through shafts 42. The cylinders 12 are dispersed in a square around a rotating cup 16. In operation, with reference to FIG. 2, molten alloy 18 is fed from a supply 20 to rotating cup 16 which is driven by a motor 30. The alloy 18 is centrifugally ejected radially from the cup 16 in sheets 22 extending along a horizontal plane. As the alloy 18 travels outward, it is disintegrated into droplets 24 by surface tension before contacting rotating chill cylinders 12. This allows each droplet 24 to be attenuated into a flake 26 before solidifying. The flakes 26, after contacting an outer surface 28 of the cylinders 12, are deflected downward into a collection area 46. The collection area 46 may include a collection box 48. The collection box 48 may also include a micro mesh filter 50 and a vacuum pump 52. A drawback to this system is uneven size distribution. Another drawback is the likely occurrence of droplets to travel between the cylinders, causing accumulations on drive motors and shaft members which will increase down time for repair and maintenance.

U.S. Pat. No. 2,825,108 discloses a method and apparatus for making metallic filaments. The apparatus includes a base having a rotating chill block which may include a spherical or ellipsoidal cavity. Molten metal is directed through an orifice onto the rotating chill block. The size of the filament produced is dependent on the ejection velocity of the molten metal out of the orifice and the impingement velocity of a surface of the chill block at which the molten metal impinges. By changing the ejection velocity equal to or less than that of the impingement velocity, small discontinuous flakes can occur.

U.S. Pat. No. 4,474,604 discloses a method of producing metal powder. The powder is formed by heating and melting a metal in a vacuum chamber. Molten metal in the form of droplets falls from the chamber and collides with a surface of a roll rotating at a high speed so as to pulverize and partially solidify the droplets. Particles formed by the roll are scattered and collected in a collecting box. An alternative embodiment uses a radially contracted mid portion on a roll to aid in conveying the flow of particles from the roll and to reduce particle size.

U.S. Pat. No. 3,797,978 discloses an apparatus for disintegrating a stream of ferroalloy into solidified spheroidal configurations. A melted stream of ferroalloy is subjected within an insulating zone to a centrifugal force and is radially dispersed into contact with a curvilinear surface. The curvilinear surface is shown as being part of a rotatable drum which rotates about a vertical axis. The apparatus also includes a shell which prevents stray material from exiting the apparatus.

U.S Pat. Nos. 4,468,241 and 4,808,097 disclose methods and apparatus for forming fibers from meltable materials. Meltable material is supplied to a distribution bowl which radially flings the melt over a rim of the bowl. The melt, as it is radially travelling outward from the bowl, encounters a jet stream of gas which breaks up forced downward by the stream and gravity into a collector housing.

U.S. Pat. No. 4,435,342 discloses a method of producing ultra fine particles by delivering a molten stream of metal onto a rotating primary annular surface, discharging molten fine droplets from an edge of the annular surface against an inclined second annular surface. The droplets upon contacting the second annular surface are subdivided and discharged to be cooled as ultra fine particles.

U.S. Pat. No. 4,613,076 discloses an apparatus and method for forming fine liquid metal droplets. The apparatus comprises a rotatable member situated in a pressurized or evacuated chamber. An electric field is provided near an edge of the rotatable member to overcome surface tension of the metal. Molten metal is directed onto a surface of the rotating member and as the liquid is thrown from the edge of the rotating member, the electric field causes fine metal droplets to form.

The need exists for an apparatus which can produce a metallic alloy flake or particle which is of the smallest magnitude. Although numerous devices have been devised to produce small metal particles, none have produced consistent flake dimensions approaching 1 micron. An additional problem with prior art devices is the inability to produce a consistently narrow distribution of particle sizes. The need exists for a method or apparatus which does not build up layers of solidified droplets on chill surfaces, thus providing an apparatus which is capable of producing a consistent flake yield and distribution throughout a production run.

SUMMARY OF THE INVENTION

It is an object of the invention to provide a flake making apparatus which is capable of producing ultra fine metal alloy particles and overcomes the deficiencies of prior art devices.

This and other objects are achieved by a flake making apparatus which utilizes rotating chill "cylinders" with concave surfaces to produce metal flakes having an ultra fine size and a uniform particle distribution. This flake making apparatus is simple to use and requires minimal maintenance.

In particular, the apparatus of the present invention for manufacturing ultra fine flakes comprises a substantially circular member of a predetermined radius for receiving a molten material and rotating at a high speed to centrifugally force the molten material radially outward in a substantially horizontal plane. A plurality of rotatable chill cylinders radially spaced around the circular member have concave outer longitudinal surfaces with all points on the concave outer surfaces substantially radially equidistant from the circular member.

DESCRIPTION OF THE DRAWINGS

FIG. 3 is a top view of a preferred embodiment of the present invention showing curved chill cylinders according to the present invention;

FIG. 5 is a top view of a more preferred embodiment showing edge features on the chill cylinders of FIG. 4.

DETAILED DESCRIPTION OF PREFERRED EMBODIMENTS

Figure 1:
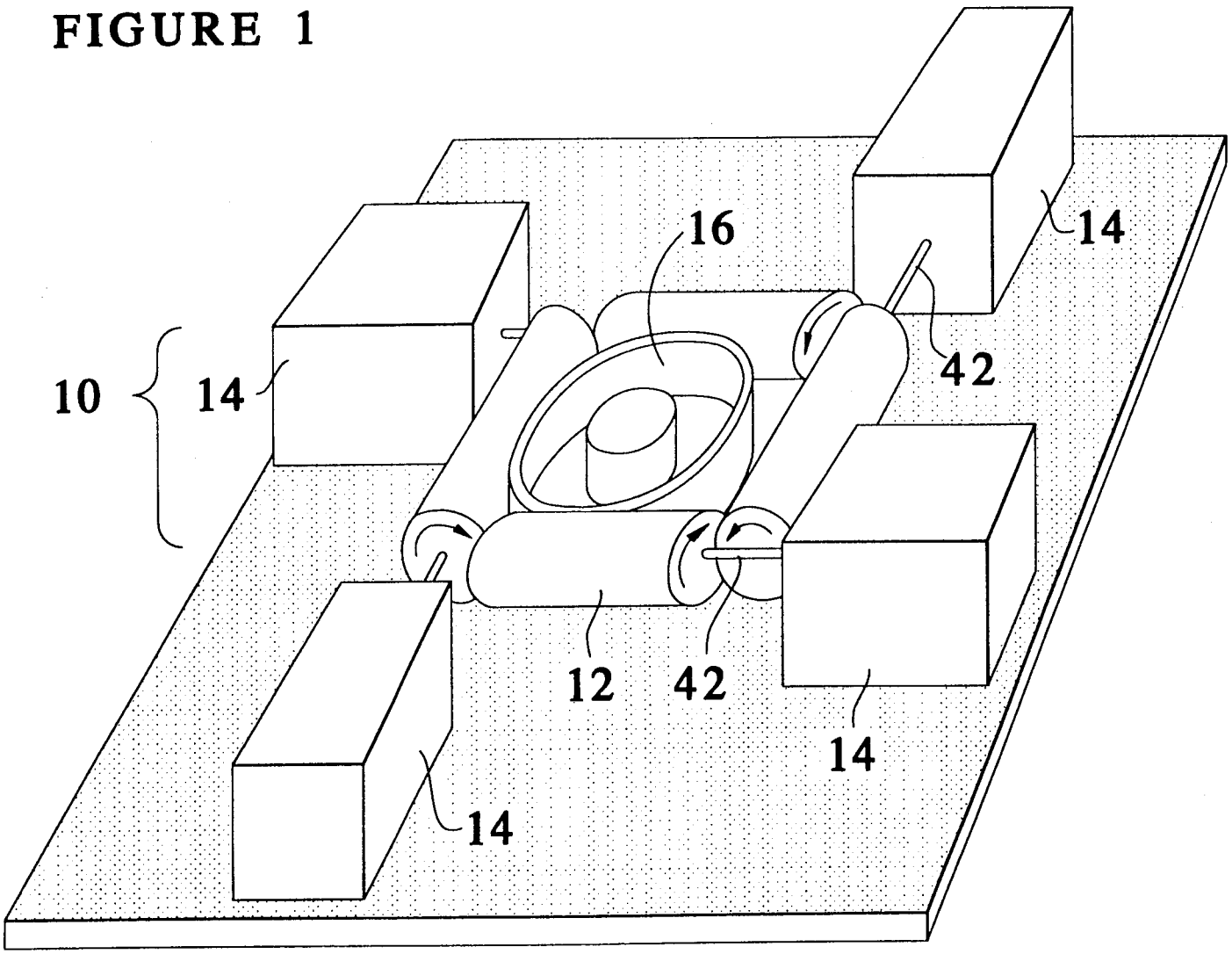
FIG. 1 is a perspective view of chill cylinders and drive means according to applicant's prior system.
Figure 2:
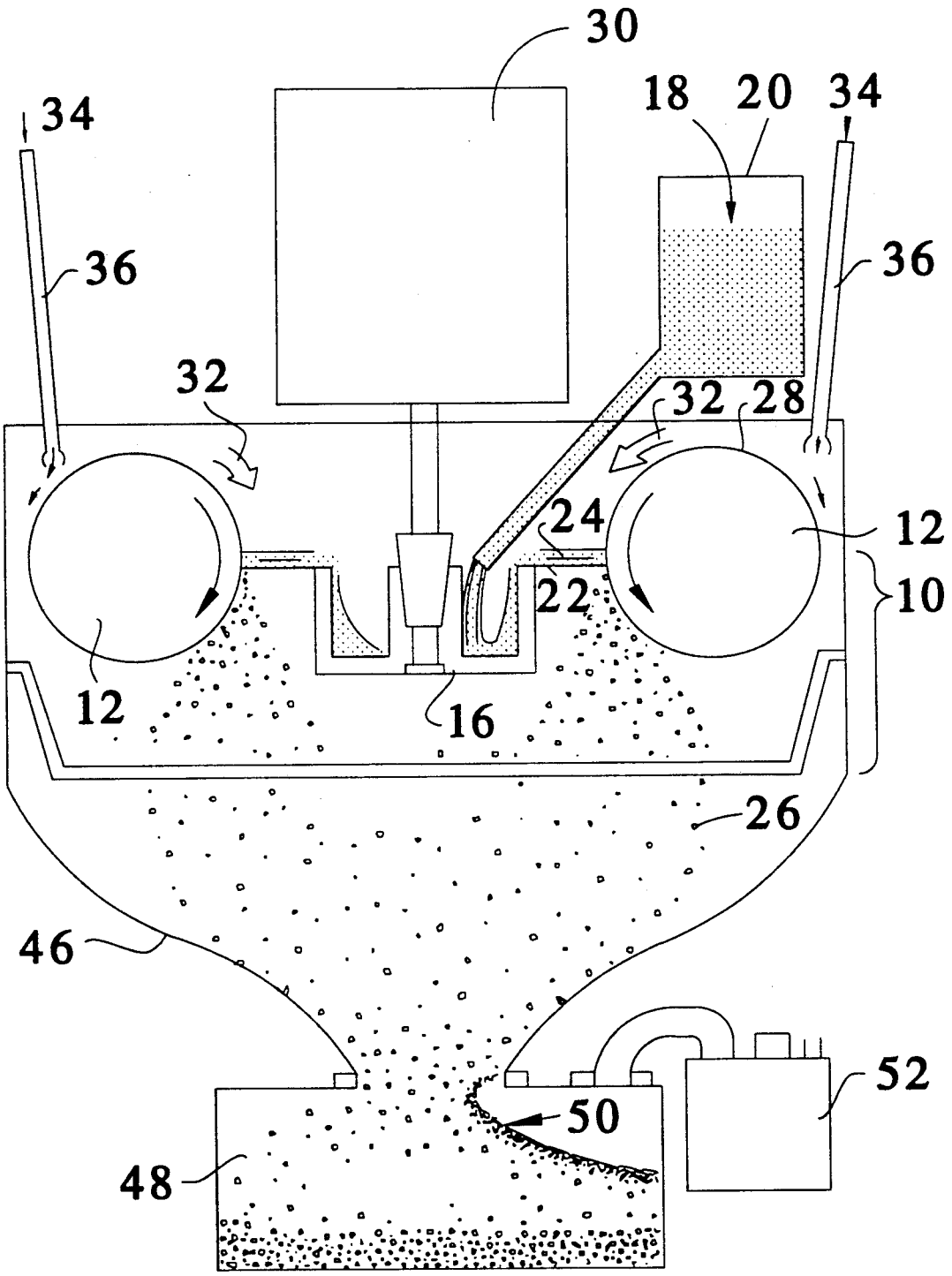
FIG. 2 is a cut away view of a flake producing apparatus according to FIG. 1.

The present invention relates to a chill block melt spinning apparatus in which molten metal or alloy is delivered to a rotating cup which centrifugally forces the metal to exit the cup tangentially in a sheet which breaks up into streams and then into a series of droplets. A plurality of rotating chill cylinders is radially spaced from the rotating cup an outward distance at which the exiting streams have broken up into droplets. The cylinders receive the streams or droplets of liquid or semisolidified metal and provide a fresh surface for each droplet to contact, forming ultra fine flakes which are deflected downward into a collecting area.

The cup which operates hot may have periphery ports through which the alloy is centrifugally forced. The cup can also be a concave disk on which molten metal is fed. Additionally, the cup can be deep with no ports, and preferably with a bottom inner diameter slightly larger than a top inner diameter. In either of the last two cases, the molten alloy generates a sheet which radially expands as it moves away from the cup. Since the volume of metal in the sheet is fixed, as the area is increased, the sheet becomes thinner. Eventually, instability develops and the sheet breaks down into ligaments which in turn break down into droplets.

The present invention utilizes chill splat cylinders which are located as close to the cup as possible after the sheet has broken up into droplets.

To obtain a proper distribution of fine flake, the feed rate of the alloy to the cup should be minimum, the rotational speed of the cup should be maximum, and the rotational speed of the chill cylinders should be as high as possible for maximum flake production.

To ensure a more uniform particle distribution, the chill cylinders include concave outer surfaces which conform to the curvature of the cup. This provides a contacting surface which is equally radially spaced from the cup at any point, so that a narrow particle size distribution can be achieved. Since the cylinder's outer surface is concavely curved, a surface near the center of curvature has a different rotational velocity relative to the rotational velocity of a surface near an end of the curvature. The velocity change is dependent on the relative radius of the cylinder's outer surfaces measured from the axis of rotation of the cylinder. By maximizing the radius of the cylinder, the difference in radius and thus in rotational velocity of various points on the concave outer surface is minimized.

By spacing adjacent cylinders close to one another, most of the droplets are deflected off the cylinders into a collecting area and not thrown between adjacent cylinders. Any material thrown between cylinders may accumulate on working parts of the machine, such as the drive motors which drive the cylinders. This would require frequent cleaning or servicing of the machine. The cylinders of the present invention preferably include edge features which block any particles which may be centrifugally thrown between adjacent cylinders.

As shown in FIG. 3, rotating chill cylinders 12 have a concave longitudinal outer surface 28. The concave longitudinal outer surface 28 substantially corresponds to a periphery of the rotating cup 16 to provide contact surfaces equidistant from the rotating cup 16 for the exiting droplets to contact. This overcomes deficiencies in the apparatus of FIG. 1, wherein the use of cylinders 12 having a uniform radius results in different travel distances for the droplets which contact near the center of the cylinder's outer surface 28, as opposed to droplets 24 which contact (or fail to contact) an edge of the cylinder's outer surface 28. This difference in travel distance has an effect on resultant flake size and flake size distribution for the yield. Preferably, a ratio of the maximum radius of the cylinder 12 to the minimum radius of outer surface 28 curvature is no more than about 2.5, and more preferably is between 2.5 and 1.25.

Figure 4:
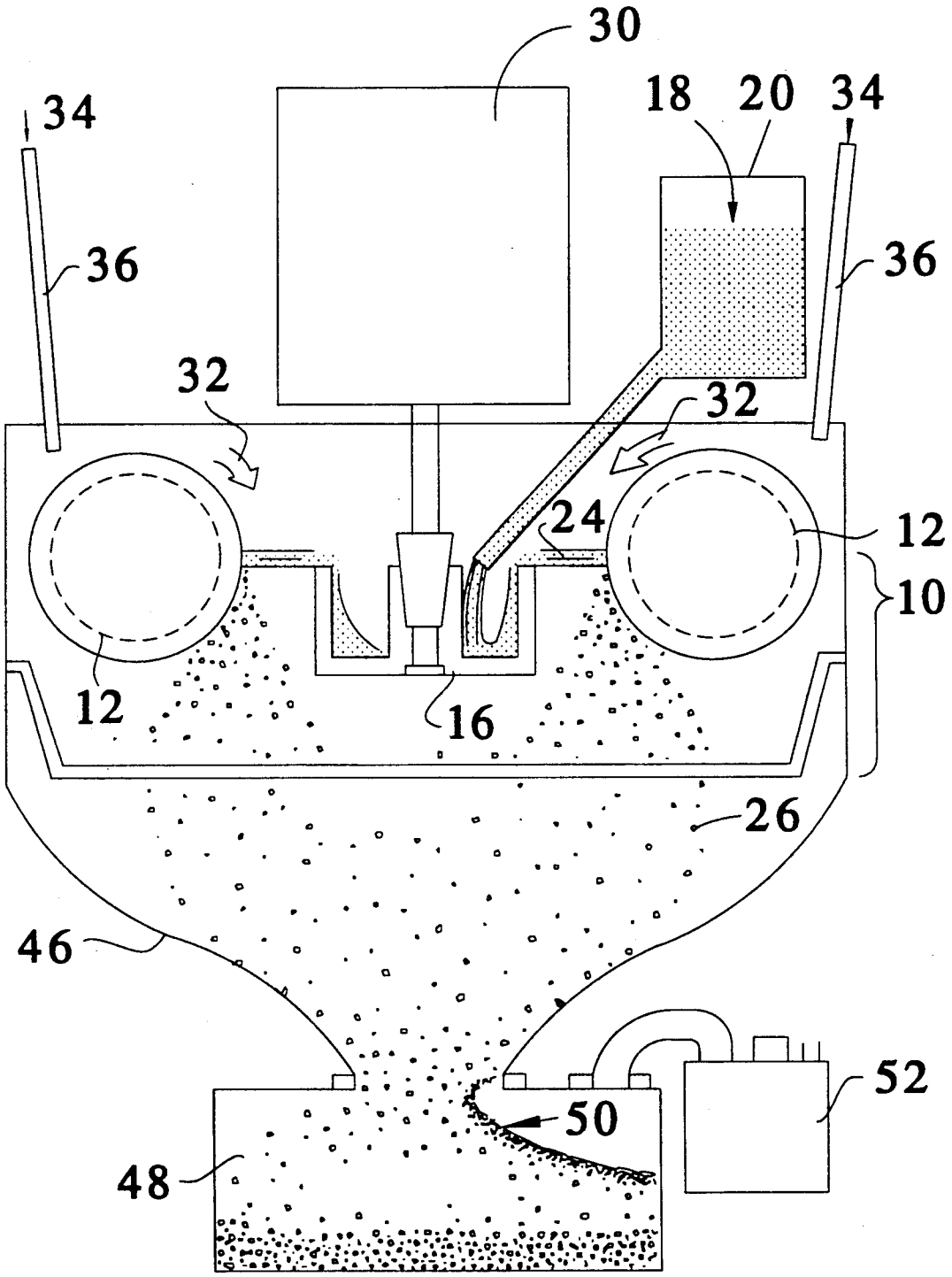
FIG. 4 is a cut away view of a flake producing apparatus according to the present invention.

Referring to FIG. 4, to prevent droplets 24 of alloy 18 from piling up on one another and developing sheet-like plating on the outer surface 28, the cylinders 12 must be rotated to provide a fresh surface for each droplet 24 to strike. However, cylinder rotation speed has some critical parameters to meet. If the cylinder rotation is too slow, a fresh surface may not be provided for each contacting droplet 24 which may result in piling up of semi-solidified material on the cylinders 12 hampering production. If the cylinder rotation is too fast, it becomes difficult for individual droplets 24 to penetrate a circumferential airstream 32 caused by the rotating cylinders 12. This will cause the droplets 24 to solidify as spheroidal or acicular powder. For these reasons, the cylinders 12 require a variable rotational velocity which preferably should be adjusted to operate at the highest possible speed which 1) allows a fresh surface for each droplet 24 to contact, while 2) preventing creation of an aerodynamic barrier which would prevent droplets from contacting the cylinder 12.

By providing the equidistant contact surfaces in the embodiment of FIG. 3, one variable in determination of ultimate particle size has been fixed, but in the process another variable has been added. Since the cylinders of FIG. 3 no longer have a constant radius, due to the longitudinal concave outer surface 28, the velocities of various points along the concave surface vary. This variance in velocity, however, can be minimized by making a radius of the cylinders 12 relatively large compared to a radius of curvature of the outer surface 28.

If the apparatus is used for producing reactive powders, it becomes advantageous to isolate the chill cylinders 12 from the atmosphere. Cooling can be achieved by introducing an inert, expandable gas 34 such as $CO_2$ in the vicinity of the cylinders 12 through a conduit 36 along the surface of the chill cylinder. This isolates the powder from the normal atmosphere in which it may react and additionally provides a refrigeration effect to keep the cylinders 12 at a cool temperature. The stream of gas also serves as a scrubber to remove any residual metal flakes. Preferably, the cylinders' outer surface 28 should be maintained at a substantially constant temperature to produce good flake consistencies. Vacuum pump 52 aids in removing the circulating gas 34 downward toward the collection box 48. This prevents cooling gas 34 from circulating toward the rotating cup 16 or supply 20 which may pre-solidify the alloy prior to proper processing. It also prevents small droplets from being trapped in an upward flow caused by an uncontrolled gas flow, which would hamper yield results.

Very good results are obtained by driving the rotating cup 16 at a high velocity while starving the feed rate of the molten alloy 18 to the cup 16. The chill cylinder 12 should be driven at a highest speed which does not produce aerodynamic turbulence, as previously mentioned. Actual speeds and flow rates will depend on the alloy selected, sizes of cylinders and rotating cup components, and size of ultimate product desired.

Additionally, edge features 38 are preferably included on one or more longitudinal edges 40 of one or more of the chill cylinders 12 as shown in FIG. 5. Edge features 38 may be configured in various shapes depending on the number of cylinders 12 used in the apparatus and the size of the gap between adjacent cylinders 12. The edge features 38 shown in FIG. 5 include protrusions 44 which extend past a periphery of the cylinder. The amount of the extension is dependent on the distance to the adjacent cylinder. The extension should be sufficient to extend slightly past an adjacent cylinder's lateral periphery and be closely spaced to an adjacent cylinder longitudinal edge to cut off or block off possible escape of radially travelling droplets between adjacent cylinders. This addition of edge features 38 increases yield by deflecting droplets that would have otherwise left the apparatus. Additionally, it prevents undue buildup of droplets on the cylinder drive motors 14 or other parts which are located near the cylinders 12. Any occurrence of droplets escaping through a gap between cylinders 12 may result in unnecessary harm to the correct operation of the apparatus, as well as making an unwanted mess and waste of materials.

Various modifications may be made without departing from the spirit and scope of the appended claims.

I claim:

1. An apparatus for manufacturing ultra fine flakes comprising:

a substantially circular member of a predetermined radius for receiving a molten material and rotating to centrifugally force said molten material radially outward in a substantially horizontal plane; and a plurality of rotatable chill cylinders radially spaced around said circular member, said cylinders having concave outer longitudinal surfaces, all points on said concave outer surfaces being substantially radially equidistant from said circular member, said cylinders having a ratio of maximum cylinder radius to a minimum cylinder radius less than 2.5.

2. The apparatus of claim 1, further including a cooling means for retaining said cylinders at a substantially constant cooled temperature.

3. The apparatus of claim 2, wherein said cooling means is a gas inlet directed toward said cylinder from a gas supply for producing a flow of gas along said cylinders.

4. The apparatus of claim 3, further including a pump located below said cylinders to draw said gas downward and prevent said gas from solidifying said material near said circular member.

5. The apparatus of claim 1, wherein said circular member is cup shaped.

6. The apparatus of claim 1, wherein said plurality of cylinders is four.

7. The apparatus of claim 1, wherein said ration is greater than or equal to 1.25.

8. The apparatus of claim 1, wherein said ratio is about 1.25.

9. A method of producing ultra fine metal flakes comprising:

discharging a stream of molten material into a rotating member having a substantially circular periphery;

driving said rotating member at a high rotational velocity sufficient to centrifugally force said molten material radially from the rotating member in a stream which forms individual droplets which contact with a plurality of rotating chill cylinders located around said rotating member, said cylinders having curved outer surfaces substantially equally radially spaced from said rotating member and having a maximum cylinder radius to minimum cylinder radius ration of less than 2.5.

10. A method according to claim 9, further comprising maintaining said cylinders at a substantially constant cooled temperature by directing an inert gas toward the cylinders.

11. A method according to claim 10, wherein said inert gas is $CO_2$.

12. A method according to claim 10, further including controlling flow of said gas and said droplets from said cylinders to said collection area by providing a vacuum pump in direct communication with said collection area and located adjacent to said collection area.

13. A method according to claim 9, wherein said ration is greater than or equal to 1.25.

14. The method of claim 13, wherein said ratio is about 1.25.

15. An apparatus for manufacturing ultra fine flakes comprising:

a substantially circular member of a predetermined radius for receiving a molten material and rotating to centrifugally force said molten material radially outward in a substantially horizontal plane; and a plurality of rotatable chill cylinders radially spaced around said circular member, said cylinders having concave outer longitudinal surfaces, essentially all points on said concave outer surfaces being substantially radially equidistant from said circular member, at least one of said rotatable chill cylinders including at least one protrusion on at least one lateral edge to substantially block radial exits of droplets between adjacent said cylinders.

16. The apparatus of claim 15, wherein at least one of said protrusion is alternately located on every other said cylinder.

17. The apparatus of claim 16, wherein every other cylinder includes two protrusions, each protrusion being on opposite edges of said cylinder.

* * * * *